US010590546B2

(12) United States Patent
Hardee

(10) Patent No.: US 10,590,546 B2
(45) Date of Patent: Mar. 17, 2020

(54) CATALYTIC OR ELECTROCATALYTIC GENERATION OF CHLORINE DIOXIDE

(71) Applicant: INDUSTRIE DE NORA S.P.A., Milan (IT)

(72) Inventor: Kenneth L. Hardee, Middlefield, OH (US)

(73) Assignee: INDUSTRIE DE NORA S.P.A., Milan (IT)

( * ) Notice: Subject to any disclaimer, the term of this patent is extended or adjusted under 35 U.S.C. 154(b) by 2 days.

(21) Appl. No.: 15/321,430

(22) PCT Filed: Jul. 17, 2015

(86) PCT No.: PCT/EP2015/066378
§ 371 (c)(1),
(2) Date: Dec. 22, 2016

(87) PCT Pub. No.: WO2016/009031
PCT Pub. Date: Jan. 21, 2016

(65) Prior Publication Data

US 2017/0211194 A1 Jul. 27, 2017

Related U.S. Application Data

(60) Provisional application No. 62/025,557, filed on Jul. 17, 2014.

(51) Int. Cl.

| | |
|---|---|
| ***C25B 1/26*** | (2006.01) |
| ***C25B 11/06*** | (2006.01) |
| ***C25B 11/04*** | (2006.01) |
| ***C25B 11/02*** | (2006.01) |
| ***C25B 11/00*** | (2006.01) |

(52) U.S. Cl.
CPC ..... *C25B 1/26* (2013.01); *C25B 11/00* (2013.01); *C25B 11/02* (2013.01); *C25B 11/0405* (2013.01); *C25B 11/0478* (2013.01)

(58) Field of Classification Search
CPC ..... C25B 1/26; C25B 11/0484
See application file for complete search history.

(56) References Cited

U.S. PATENT DOCUMENTS

| | | | | |
|---|---|---|---|---|
| 426,263 | A | 4/1890 | Goff | |
| 3,873,437 | A | 3/1975 | Pulver | |
| 4,362,707 | A | 12/1982 | Hardee et al. | |
| 4,381,290 | A | 4/1983 | Hardee et al. | |
| 4,388,162 | A | 6/1983 | Sammells et al. | |
| 4,426,263 | A * | 1/1984 | Hardee | C25B 11/0484 205/556 |
| 4,501,824 | A | 2/1985 | Hardee et al. | |
| 6,203,688 | B1 | 3/2001 | Lipsztajn et al. | |

FOREIGN PATENT DOCUMENTS

CA 2157827 A1 3/1997

OTHER PUBLICATIONS

B.R. Deshwal & H.K. Lee. "Manufacture of Chlorine Dioxide from Sodium Chlorate: State of the Art" Journal of Industrial and Engineering Chemistry . vol. 11, No. 3. pp. 330-346 (Year: 2005).*
International Search Report and Written Opinion for International Application No. PCT/EP2015/066378 (dated Oct. 19, 2015) (7 Pages).
International Preliminary Report on Patentability for International Application No. PCT/EP2015/066378 (dated Jul. 22, 2016) (13 Pages).

* cited by examiner

*Primary Examiner* — Steven A. Friday
(74) *Attorney, Agent, or Firm* — Lucas & Mercanti, LLP

(57) ABSTRACT

The present invention concerns an electrode element having a valve metal substrate, a first catalyst component applied to said substrate, said first catalyst component suitable for evolving oxygen from an aqueous solution under anodic polarization, a second catalyst component suitable for generating chlorine dioxide from a chlorate solution in acidic environment; said first and second catalyst component being electrically insulated from each other. The inventions also concern an electrolytic cell having such an electrode element and a process for the generation of chlorine dioxide on a catalyst component an electrochemical cell comprising such an electrode element.

11 Claims, 1 Drawing Sheet

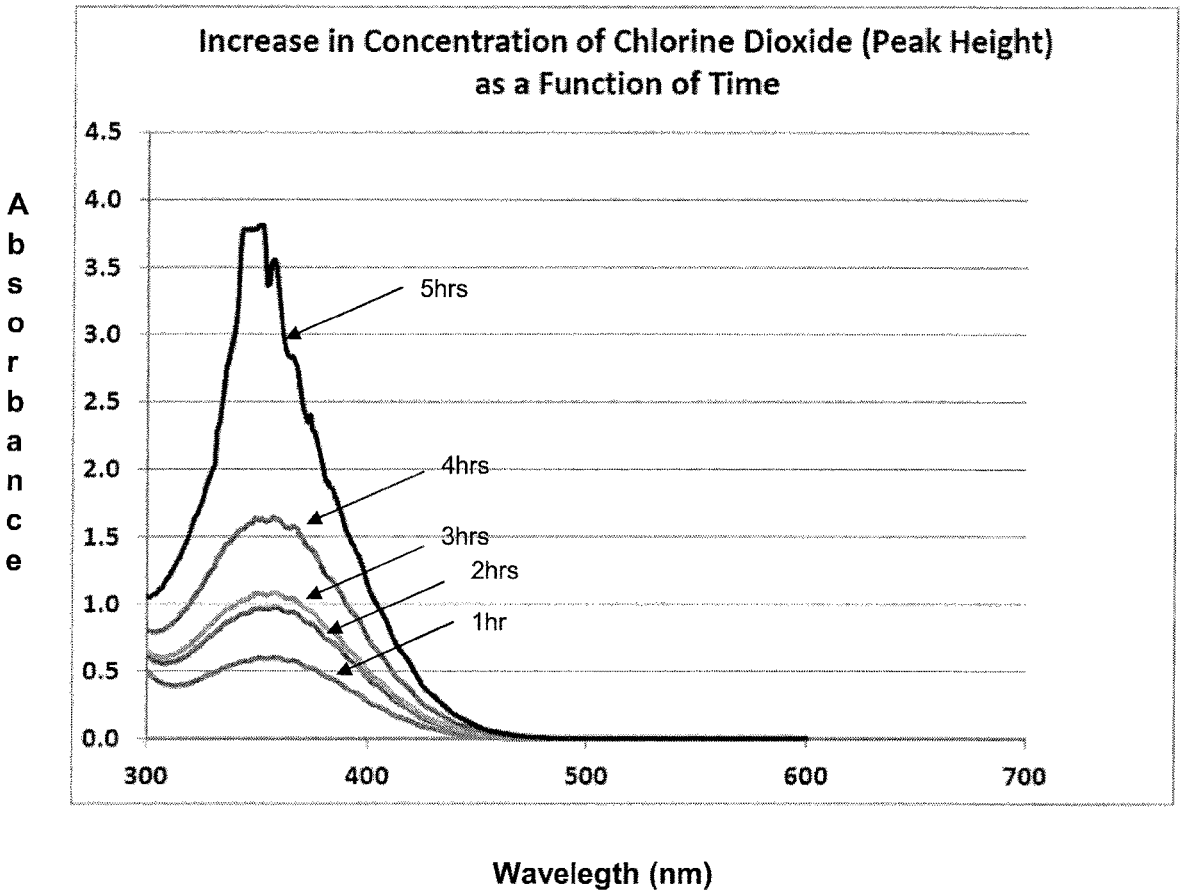
Increase in Concentration of Chlorine Dioxide (Peak Height)
as a Function of Time
Absorbance
4.5
4.0
3.5
3.0
2.5
2.0
1.5
1.0
0.5
0.0
300
400
500
600
700
5hrs
4hrs
3hrs
2hrs
1hr
Wavelegth (nm)

CATALYTIC OR ELECTROCATALYTIC GENERATION OF CHLORINE DIOXIDE

This application is a U.S. national stage of PCT/EP2015/066378 filed on Jul. 17, 2015 which claims the benefit of priority from U.S. Provisional Patent Application No. 62/025,557 filed Jul. 17, 2014 the contents of each of which are incorporated herein by reference.

FIELD OF THE INVENTION

The invention relates to the production of chlorine dioxide ($ClO_2$) and particularly to a suitable electrode element and a catalytic process for the production of chlorine dioxide.

BACKGROUND OF THE INVENTION

Historically, $ClO_2$ has been commercially prepared by a reaction between a metal chlorate in aqueous solution, such as sodium chlorate ($NaClO_3$), and a relatively strong acid such as sulphuric, phosphoric or hydrochloric acid.

Generally, processes for generating $ClO_2$ make use an alkali chlorate-containing feedstock, usually $NaClO_3$, that also includes a halide salt of alkali metal or other reducing agents. The sodium chlorate feedstock for such a $ClO_2$ production process is typically generated by electrolysis of sodium chloride brine in any well-known manner. When chlorides are used as the reducing agent, the mixture of brine and chlorate is directly fed to one or more reactors where the feedstock contacts a desired acid and reacts to form $ClO_2$. Due to the high amount of acidity required, e.g. 5-10N acid, coupled with the need for a reducing agent, small scale production of $ClO_2$ from $NaClO_3$ is not practiced. Examples of $ClO_2$ generation processes via electrochemical or catalytic reduction of sodium chlorate in strong acid are reported for example in U.S. Pat. Nos. 4,501,824, 426,263, 4,381,290 and 4,362,707. These prior art teachings allow to dispense with the need for a separate reducing agent, still requiring however a chemical supply of acid in the process.

SUMMARY OF THE INVENTION

Under one aspect, the invention relates to an electrode element comprising a valve metal substrate; a first catalyst component applied to said substrate, said first catalyst component suitable for evolving oxygen from an aqueous solution under anodic polarisation; a second catalyst component suitable for generating chlorine dioxide from a chlorate solution in acidic environment; said first and second catalyst component being electrically insulated from each other.

By virtue of the above arrangement, the anodic evolution of oxygen with the consequent generation of protons brings about a lowering of the local pH of the solution at the surface of the second catalyst component. In other words, the electrochemical anodic reaction produces the acid concentration suitable for carrying out the catalytic reduction of chlorate to chlorine dioxide without the need of any external addition of acid. The electrode element of the invention is then suitable for generating chlorine dioxide starting from water and a chlorate solution only, thus avoiding the handling of strong mineral acids such as sulphuric acid.

With electrode element it is herewith intended an integral electrode comprising two distinct catalyst components arranged in a single stand-alone piece, the two catalyst components being either spaced apart by means of a suitable insulating spacer, or in intimate contact but electrically insulated from each other.

In one embodiment, the second catalyst component of the electrode element is supported on a ceramic support. The ceramic support, for example, can be in the form a discrete ceramic media such as distillation saddles.

In another embodiment, the second catalyst component of the electrode element is supported on a metallic support.

This second catalyst component can be optionally polarized to a lower potential to enhance the production of chlorine dioxide.

In one embodiment, the second catalyst component of the electrode element is connected to a power supply.

In one embodiment, the first catalyst component of the electrode element comprises noble metal oxides.

In one embodiment, in the electrode element according to the invention the second catalyst component is a mixture of noble metal oxides selected from the group consisting of ruthenium oxide, iridium oxide, palladium oxide, rhodium oxide and platinum oxide. Optionally, the second catalyst component also comprises a valve metal oxide.

In one embodiment, the second catalyst component of the electrode element is in the form of a ceramic or metallic sheet or mesh or of a porous material.

Under another aspect, the invention relates to an electrolytic cell comprising at least one electrode element as described above.

In one embodiment, the electrolytic cell is equipped with electrode elements disposed as an array of intercalated first catalyst components applied to substrates and second catalyst components, the first and second catalyst components being reciprocally insulated.

Under yet another aspect, the invention relates to a process for the generation of chlorine dioxide on a catalyst component comprising the steps of:

- providing an electrochemical cell comprising at least one cathode and at least one electrode element as described above as the anode;
- supplying said cell with an aqueous feedstock containing a chlorate solution;
- electrolyzing said feedstock by passing an electric current between the cathode and the anode thereby forming oxygen and acidity on the surface of said first catalyst component and supplying acidity to the surroundings of the surface of said second catalyst layer;
- stripping and recovering chlorine dioxide generated on the catalytic layer.

Preferably, the solution is electrolyzed at a temperature of 40° C. to 90° C.

The following examples are included to demonstrate particular embodiments of the invention, whose practicability has been largely verified in the claimed range of values. It should be appreciated by those of skill in the art that the compositions and techniques disclosed in the examples which follow represent compositions and techniques discovered by the inventors to function well in the practice of the invention; however, those of skill in the art should, in light of the present disclosure, appreciate that many changes can be made in the specific embodiments which are disclosed and still obtain a like or similar result without departing from the scope of the invention.

EXAMPLE

An electrochemical cell comprising a 0.5 cm-diameter coated titanium rod as the anode was prepared. The coating of the anode consisted of 10 g/m$^2$ of mixed oxides of iridium and tantalum in a 2:1 molar ratio. A coated titanium expanded mesh serving as support for the second catalyst element was wrapped around the rod with a spacer arranged therebetween to provide for electrical insulation. The coating of the titanium mesh consisted of 10 g/m$^2$ of $RuO_2/RhO_2$ in a 1:2 molar ratio. A 2M $NaClO_3$ solution was supplied as the electrolyte feedstock. The reaction was carried out at a temperature of 61° C. and at an anode current density of 50 mA/cm$^2$.

The test was run for 5 hours. A sample was taken every one hour and characterised in a UV/VIS Spectrophotometer (Hach DR 5000). The FIGURE shows the increase in chlorine dioxide concentration as a function of time.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. An electrode element consisting of an integral electrode comprising two distinct catalyst components arranged in a single piece comprising:

a valve metal substrate, wherein the valve metal substrate is a titanium rod;

a first catalyst component applied to said substrate, said first catalyst component suitable for evolving oxygen from an aqueous solution under anodic polarization;

a second catalyst component suitable for generating chlorine dioxide from a chlorate solution in acidic environment, the second catalyst component is supported on a support and wrapped around the first catalyst component;

a spacer arranged between the first catalyst component and the second catalyst component supported on the support, thereby electrically insulating from each other said first and second catalyst components.

2. The electrode element according to claim 1, wherein the support is a ceramic support.

3. The electrode element according to claim 1, wherein the support is a metallic support.

4. An electrolytic cell comprising at least one electrode element as described in claim 3 and a power supply, wherein said second catalyst component is connected to said power supply.

5. The electrode element according to claim 1, wherein said first catalyst component comprises noble metal oxides.

6. The electrode element according to claim 1, wherein said second catalyst component is a mixture of noble metal oxides selected from the group consisting of ruthenium oxide, iridium oxide, palladium oxide, rhodium oxide and platinum oxide, optionally comprising a valve metal oxide.

7. The electrode element according to claim 1, wherein said second catalyst component is in the form of a sheet, a mesh or a porous material.

8. An electrolytic cell comprising at least one electrode element as described in claim 1.

9. The electrode element according to claim 1, wherein the first catalyst component comprises mixed oxides of iridium and tantalum in a 2:1 molar ratio.

10. The electrode element according to claim 1, wherein the second catalyst component comprises ruthenium oxide and rhodium oxide in a 1:2 molar ratio.

11. A process for the generation of chlorine dioxide on a catalyst component comprising the steps of:

providing an electrochemical cell comprising at least one cathode and at least one electrode element as described in claim 1 as anode;

filling said cell with an aqueous feedstock containing a chlorate solution;

electrolyzing said feedstock by passing an electric current between the cathode and the anode thereby forming oxygen and acidity on the surface of said first catalyst component and thereby acidity in close contact with the surface of said second catalyst layer; and stripping and recovering the chlorine dioxide generated on said second catalytic layer.

* * * * *